US008356844B2

(12) United States Patent
Baic et al.

(10) Patent No.: US 8,356,844 B2
(45) Date of Patent: Jan. 22, 2013

(54) FLUSH LATCH WITH POSITIVE LOCK

(75) Inventors: Zarko Baic, Sylmar, CA (US); Zeljko Baic, Sylmar, CA (US)

(73) Assignee: Avibank Manufacturing, Inc., North Hollywood, CA (US)

( * ) Notice: Subject to any disclaimer, the term of this patent is extended or adjusted under 35 U.S.C. 154(b) by 607 days.

(21) Appl. No.: 12/315,150

(22) Filed: Nov. 26, 2008

(65) Prior Publication Data

US 2009/0134637 A1 May 28, 2009

Related U.S. Application Data

(60) Provisional application No. 61/004,432, filed on Nov. 26, 2007.

(51) Int. Cl.
*E05C 3/04* (2006.01)

(52) U.S. Cl. ..... 292/205; 292/DIG. 31

(58) Field of Classification Search ..... 292/205, 292/202, 203, 95, 109, 115, DIG. 11, DIG. 31, 292/DIG. 40
See application file for complete search history.

(56) References Cited

U.S. PATENT DOCUMENTS

| | | | | | |
|---|---|---|---|---|---|
| 2,339,537 | A * | 1/1944 | Wise | ..... | 292/110 |
| 4,341,407 | A * | 7/1982 | Zankich | ..... | 292/111 |
| 4,548,435 | A * | 10/1985 | Bourne | ..... | 292/229 |
| 4,682,800 | A * | 7/1987 | Lovelace, Jr. | ..... | 292/247 |
| 4,979,766 | A | 12/1990 | Wasilewski | | |
| 5,011,200 | A * | 4/1991 | Glancy et al. | ..... | 292/113 |
| 5,044,679 | A | 9/1991 | Barnes et al. | | |
| 5,152,559 | A | 10/1992 | Henrichs | | |
| 5,192,098 | A | 3/1993 | Barnes et al. | | |
| 5,454,239 | A * | 10/1995 | Esaki et al. | ..... | 70/208 |
| 6,120,070 | A | 9/2000 | Myers | | |
| 2011/0101710 | A1 * | 5/2011 | Elbrecht et al. | ..... | 292/202 |

* cited by examiner

*Primary Examiner* — Carlos Lugo
*Assistant Examiner* — Mark Williams
(74) *Attorney, Agent, or Firm* — James M. Duncan, Esq.; Klein, DeNatale, Goldner, Cooper, etc.

(57) ABSTRACT

An aircraft panel latch comprises an upper latch member comprising a rotatable lock member, a lock member movement means, and a lock position visual indicator. The lower latch member is mounted to a support structure. The lower latch and the upper latch members are pivotally connected. The lower latch member comprises a lock member retention structure. The visual indicator can comprise color coded indicia, where the alignment of a first color set indicates an unlocked position and the alignment of a second color set indicates a locked position. The visual indicator can comprise the physical location of the lock member movement means relative to the lock member. The visual indicator can comprise the physical location of the lock member movement means in combination with the colored indicia. The lock member retention structure can further comprise a ramp, a spring, or both a ramp and spring. The latch can be locked and unlocked using a hex tool.

10 Claims, 11 Drawing Sheets

FLUSH LATCH WITH POSITIVE LOCK

CROSS-REFERENCE TO RELATED APPLICATIONS

U.S. Provisional Application No. 61/004,432 for this invention was filed on Nov. 26, 2007, for which application these inventors claim domestic priority.

BACKGROUND OF THE INVENTION

This invention generally relates to latches for panels and doors, particularly latches used for the exterior of aircraft. This invention specifically relates to latch assemblies which provide a positive indication whether the latch is in the locked or unlocked position. These latches are particularly useful for use on the exterior surfaces of aircraft where it is important that the latch present a flush surface with the aircraft body and also clearly indicate whether it is in the locked or unlocked position.

Latches utilized on the exteriors of the aircraft are designed in accord with the required aerodynamic properties of the aircraft. Such latches are generally flush mounted with the panels or doors secured by the latch. Because the equipment covered or contained by the exterior doors or panels may require access for maintenance and servicing, the latch should be relatively easy to open and close. However, in addition to providing relative ease in opening and closing of the latch, the latch should also provide a positive locking feature. It is also desirable that the latch provide a positive visual indication of whether the latch is in the locked and/or unlocked position.

DESCRIPTION OF THE INVENTION

The disclosed device is an aircraft panel latch that comprises an upper latch member that further comprises a rotatable lock member. There is a lock member movement means that is activated by an activation tool to lock and unlock the latch, and a lock position visual indicator. The lock position visual indicator provides a visual indication of the locked or unlocked status of the latch, thus obviating the need to physically manipulate the latch to determine the locked or unlocked status of the latch. The lower latch member comprises a lock member retention structure that retains the lock member, and a support structure that is attached to the aircraft panel. The lower latch member is attached using the support structure to the panel the latch is used to close. The lower latch and the upper latch members are pivotally connected, and the upper latch member pivots upward to clear the panel when the lock is unlocked and disengaged. The upper latch member remains against the lower latch member when unlocked but not disengaged.

The visual indicator can comprise color coded indicia, where the alignment of a first color set indicates an unlocked position and the alignment of a second color set indicates a locked position. The visual indicator can comprise the physical location of the lock member movement means relative to the lock member. The lock member movement means would be flush with the surface of the latch position visual indicator in a locked state and not flush with the surface of the latch position visual indicator in an unlocked state. The visual indicator can comprise the physical location of the lock member movement means in combination with the colored indicia, wherein a person could use both indicators to ascertain the locked or unlocked status of the latch. Thus, if a person was color-blind and unable to differentiate between red and green, the disclosed latch would still provide a positive visual indication of the locked state of the latch.

The colored indicia would likely best be chosen from readily recognizable combinations such as red to indicate an unlocked state, or green to indicate a locked state.

The lock member retention structure can further comprise an inclined ramp upon which the lock member rotates upward to provide positive locking. Alternatively, both a ramp and spring may be used to positively ensure the retention of the latch in the locked state. The latch can be locked and unlocked using a hex tool.

While the above is a description of various embodiments of the present invention, further modifications may be employed without departing from the spirit and scope of the present invention. Thus the scope of the invention should not be limited by the specific structures disclosed. Instead the true scope of the invention should be determined by the following claims.

DETAILED DESCRIPTION OF THE INVENTION

Figure 1:
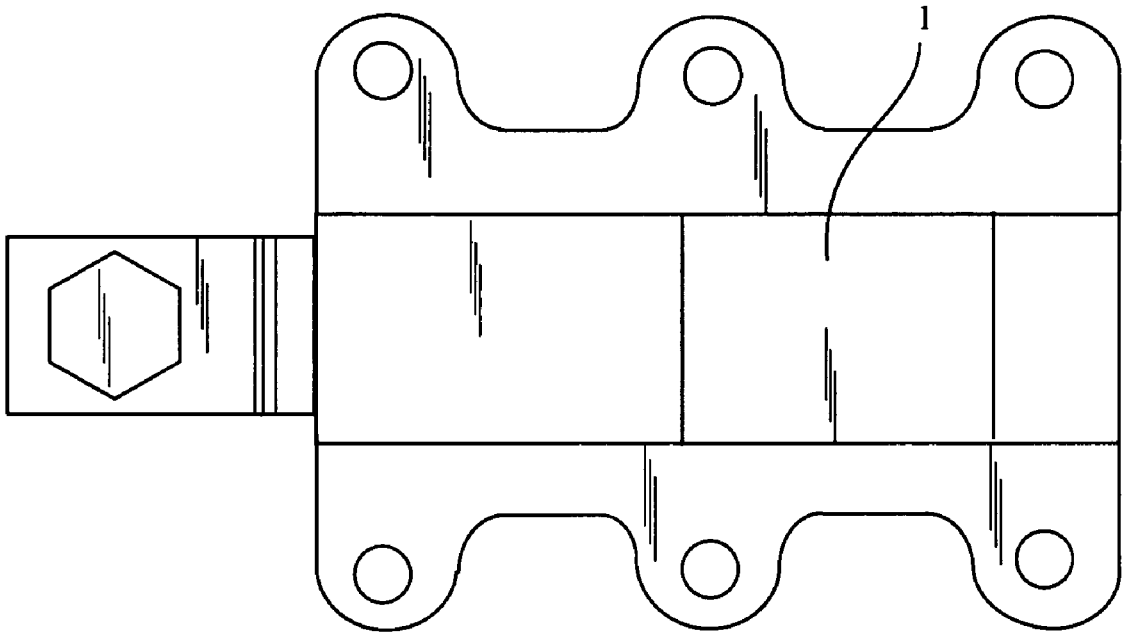
FIG. 1 is a top view of a previous flush latch.
Figure 2:
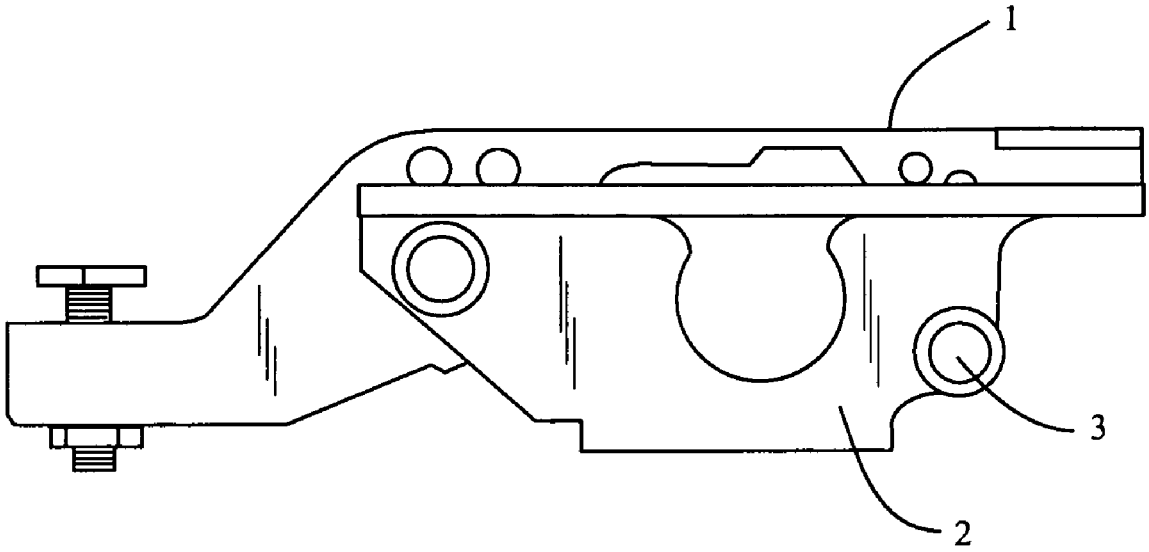
FIG. 2 is a side view of a previous flush latch.
Figure 3:
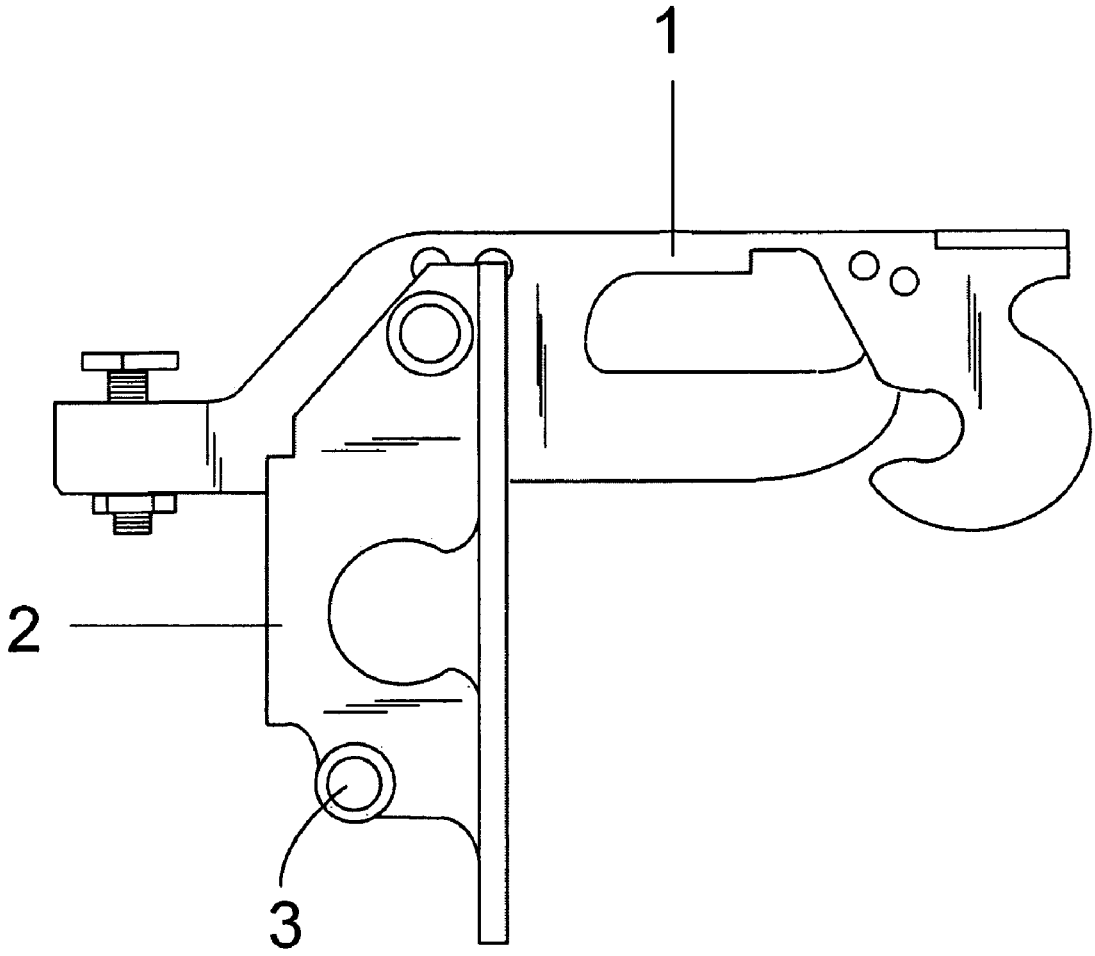
FIG. 3 is side view of a previous flush latch in the open position.

A top view of a previous flush latch is shown in FIG. 1 and a side view is shown in FIG. 2. The same previous flush latch is shown in FIG. 3 in the open position. This particular latch is opened by pressing down on latch button 1, at which point the latch catch releases allowing the latch to open by spring bias. As shown in the figures, this previous flush mounted latch does not provide a positive visual indication that the latch is in the locked position beyond the latch appearing to be in the closed position, thereby suggesting the latch catch 2 has engaged the pin 3.

Figure 4:
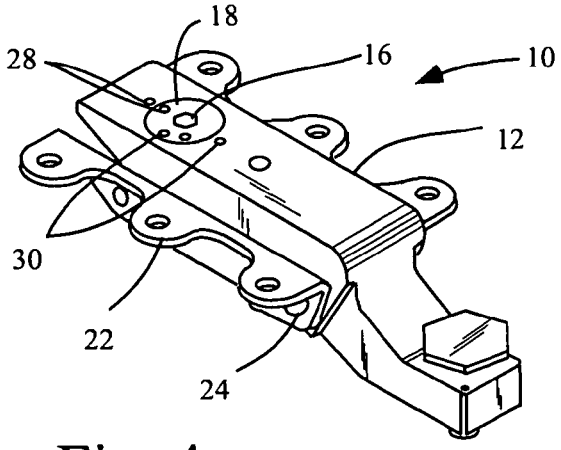
FIG. 4 is an isometric view of an embodiment of the present flush latch viewed from the top in the closed and locked position.

The present invention is directed to a flush mount latch 10 for use, among other things, on the exterior of aircraft, particularly for securing panels and inspection covers. The disclosed device is shown in FIGS. 4 through 13. FIG. 4 shows an isometric view of an embodiment of the present latch 10 in the closed position. The upper latch member 12 is positioned between the supports 22 of the lower latch member 20 when in the unlocked and not released position and when in the locked position. The upper latch member 12 is pivotally connected 24 to the lower latch member 20. The skin of the aircraft panel would be attached to the supports 22 and the upper latch member 12 would thus be flush with the skin of the aircraft. The flush mount latch 10 is in a locked position, which is indicated by the alignment of the first color set 28 and the lock member movement means 16 being flush with the surface of the lock position visual indicator 18.

Figure 5:
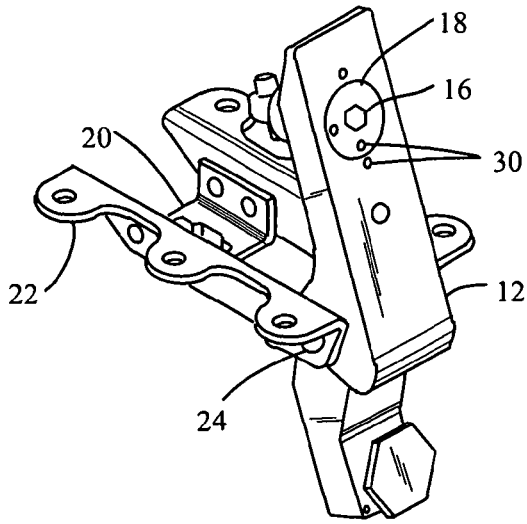
FIG. 5 is an isometric view of an embodiment of the present flush latch viewed from the top in an open and unlocked position, viewed from the pivot end.

FIG. 5 shows an isometric view of an embodiment of the present latch 10 in the open position, viewed from the pivot 24 end. The flush mount latch 10 is in an unlocked position, which is indicated by the alignment of the second color set 30 and the lock member movement means 16 not being flush with the surface of the lock position visual indicator 18. The lower latch member 20 can be seen attached between the supports 22. The upper latch member 12 has been pivoted on the pivotal connection 24 so that the aircraft panel that the supports 22 are connected to may be raised for access to the space or components located within the space covered by the panel.

Figure 6:
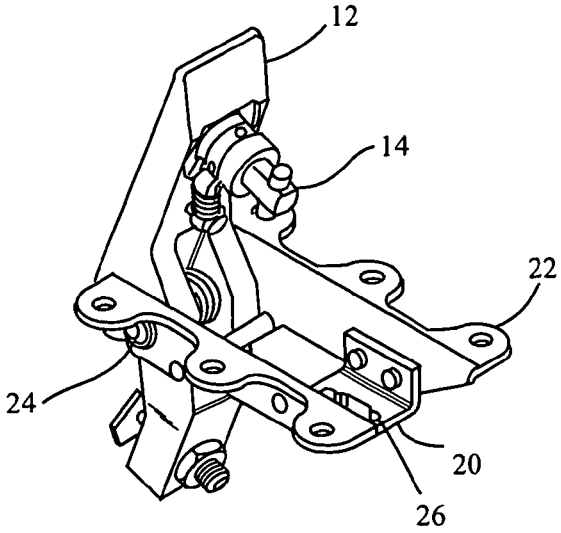
FIG. 6 is an isometric view of an embodiment of the present flush latch viewed from the top in an open and unlocked position, showing one embodiment of locking mechanism.

FIG. 6 shows an isometric view of an embodiment of the present latch in the open position, in which the lock member retention structure 26 may be seen in the lower latch member 20. The lock member 14 is aligned with the lock member retention structure 26, as would be expected in an unlocked position. The upper latch 12 is pivoted 24 back from the lower latch member 20, and the support structure 22 of the lower latch member 20 can be seen cradling the lock retention member 26.

Figure 7:
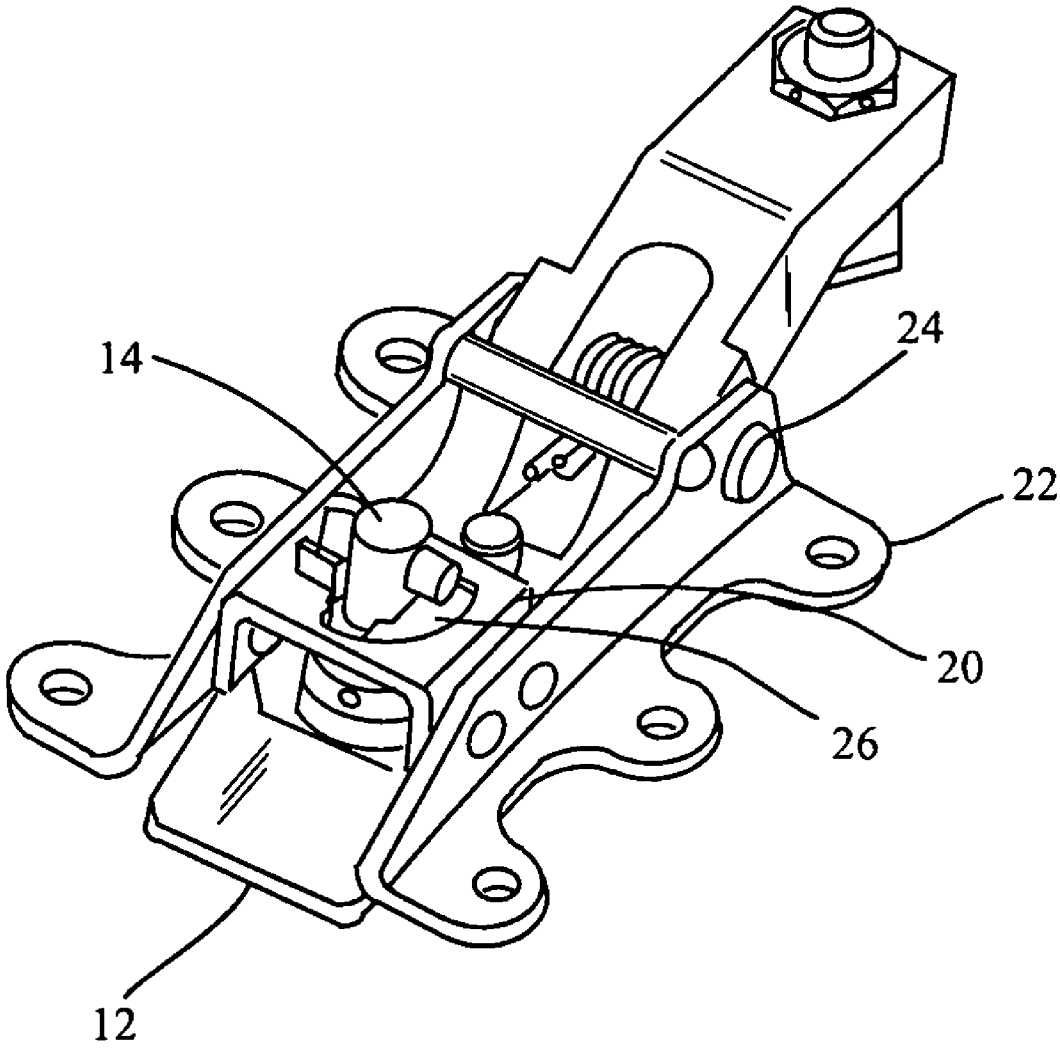
FIG. 7 is an isometric view of an embodiment of the present flush latch viewed from the bottom, showing how the leg of the locking mechanism is engaged and may be positively locked by a ramping structure.

FIG. 7 shows an isometric view of the bottom of an embodiment of the present latch 10 in the closed position. The upper latch member 12 can be seen, as can the pivot 24 that joins the upper latch member 12 and the lower latch member 20. The lock member 14 is shown in the locked position, as the lock member 14 is at a right angle to the lock member retention structure 26 of the lower latch member 20. The support structure 22 of the lower latch member 20 could be riveted or otherwise connected mechanically to the panel of the aircraft.

Figure 8:
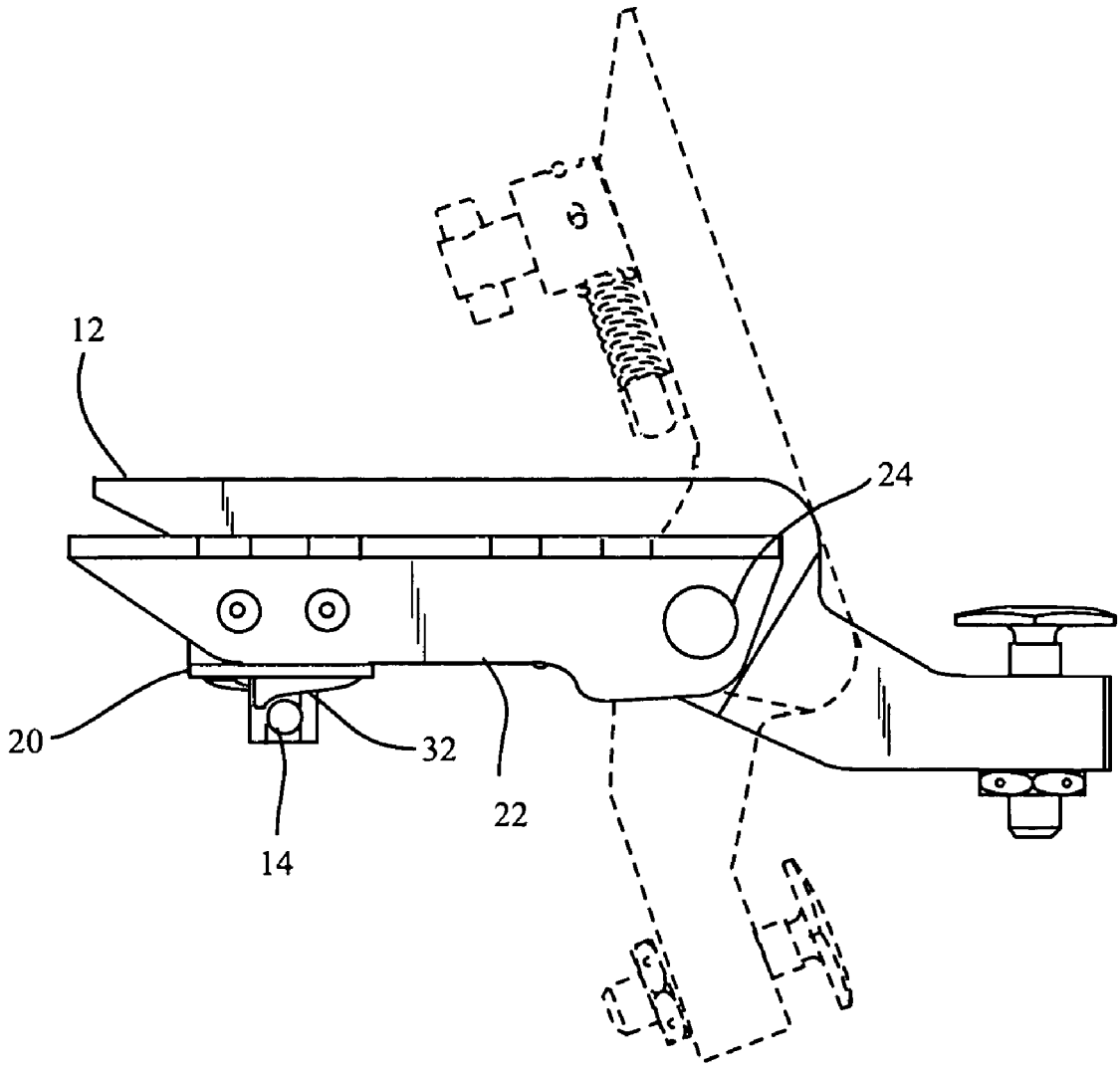
FIG. 8 schematically shows a side view of an embodiment of the present flush latch, and shows the movement between open and closed.

FIG. 8 shows the movement between an open and raised position of an embodiment of the present latch, and a closed and lowered position of the embodiment of the present latch. The open and raised position is shown in dashed lines, as the upper latch member 12 would be pivoted 24 relative to the lower latch member 20. The spacing of the support structure 22 can be seen as lower than the upper latch member 12, to allow the upper latch member 12 to fit flush against the skin of the aircraft when installed with the support structure 22 attached to the skin or panel of the aircraft. The lower latch member 20 can comprise a ramp 32 that positively retains the lock member 14 through an increase in retention pressure between the ramp 32 and the lock member 14.

Figure 9:
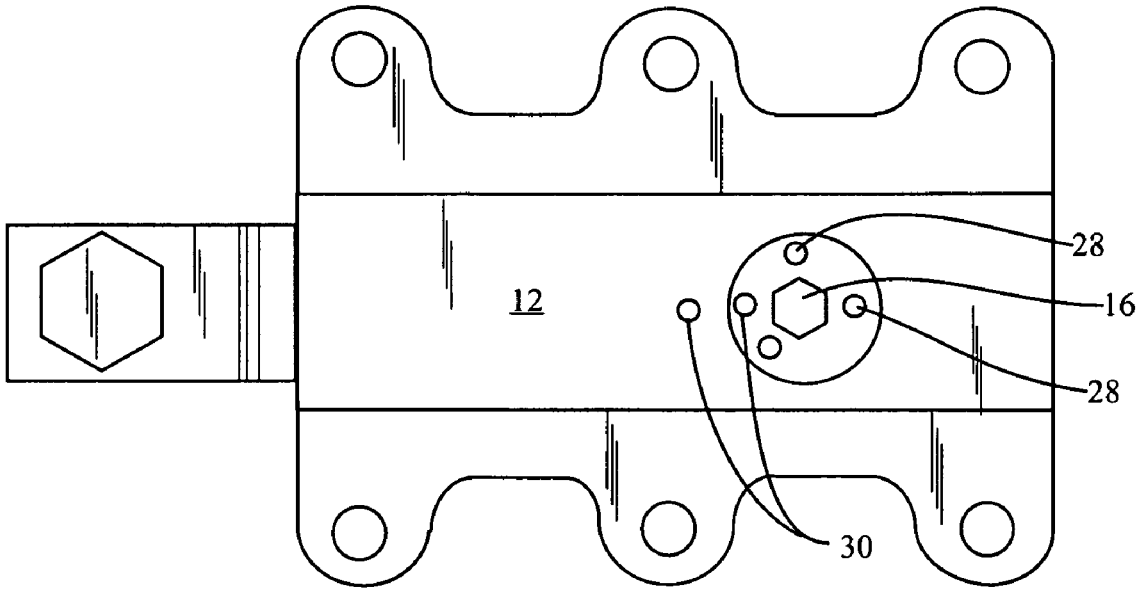
FIG. 9 shows a top view of an embodiment of the present flush latch showing how the hex plunger and visual indicator dots may be utilized to provide visual confirmation that the latch is in the locked position.
Figure 10:
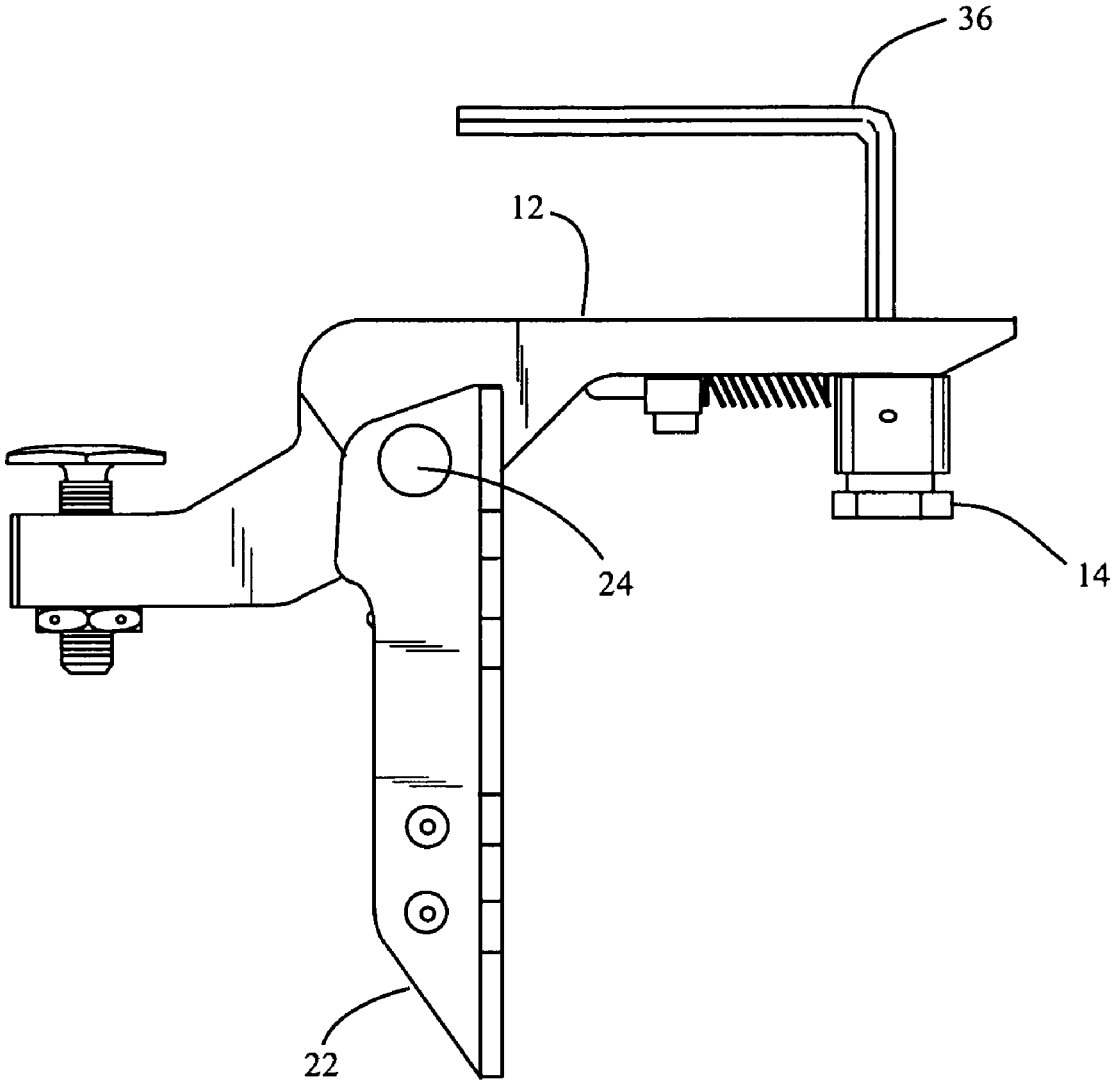
FIG. 10 shows a side view of an embodiment of the present flush latch in which a hex tool has been utilized to unlock the latch.

FIG. 9 shows a top view of an embodiment of the disclosed apparatus in the closed position. When this embodiment is locked in the closed position, there are two visual indications that the latch is locked in the closed position. First, the lock member movement means 16 on the top of the upper latch 12 covers a hex recess until a hex tool 36 is pressed in and rotated. Therefore, when the lock member movement means 16 is flush with the lock position visual indicator 18 of the upper latch member 12, the latch is in the locked position. The second visual indicator is provided by alignment of a first color set of dots 28 such as red reference dots, and alignment of a second color set of dots 30, such as green reference dots. When the second set of color dots 30 are aligned as shown in FIG. 9, the latch is in the locked position. When the first set of color dots 28 are aligned the latch is in the unlocked position and the lock member movement means 16 is depressed below the top of the latch. FIG. 10 shows a hex tool 36 inserted into the lock member movement means 16 and the latch is in the open position. The upper latch member 12 is pivoted 24 relative to the support structure 22, and the lock member is not retained by the lower latch member 20.

Figure 11:
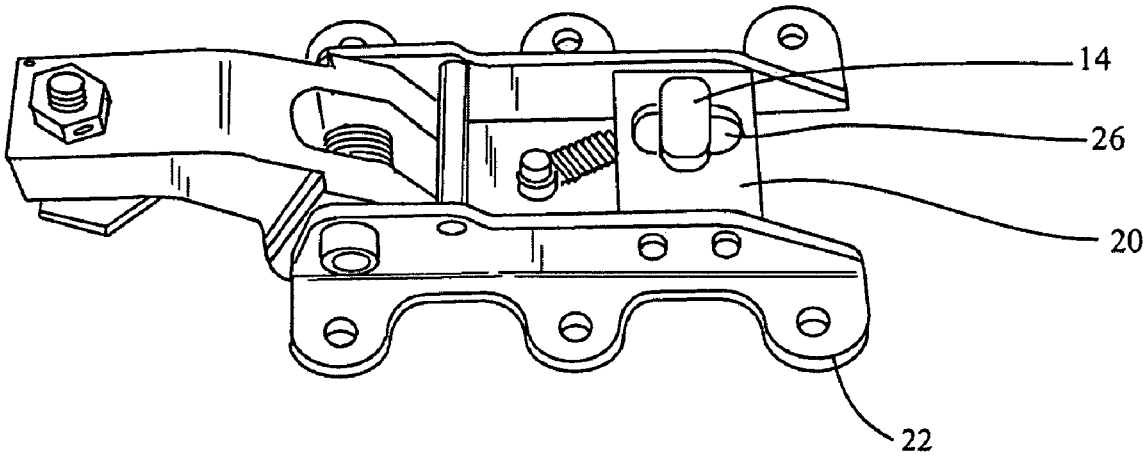
FIG. 11 shows a bottom view of an embodiment of the present flush latch in the locked position.

As shown in FIG. 11, the lock member 14 locks to a lock member retention structure 26 of the lower latch member 20. The lock member 14 is shown fully engaged with the lock member retention structure 26 of the lower latch 20. As best shown in FIG. 8, lock member retention structure 26 may have a ramping member 32 upon which the lock member 14 rotates upward to provide positive locking.

Figure 12:
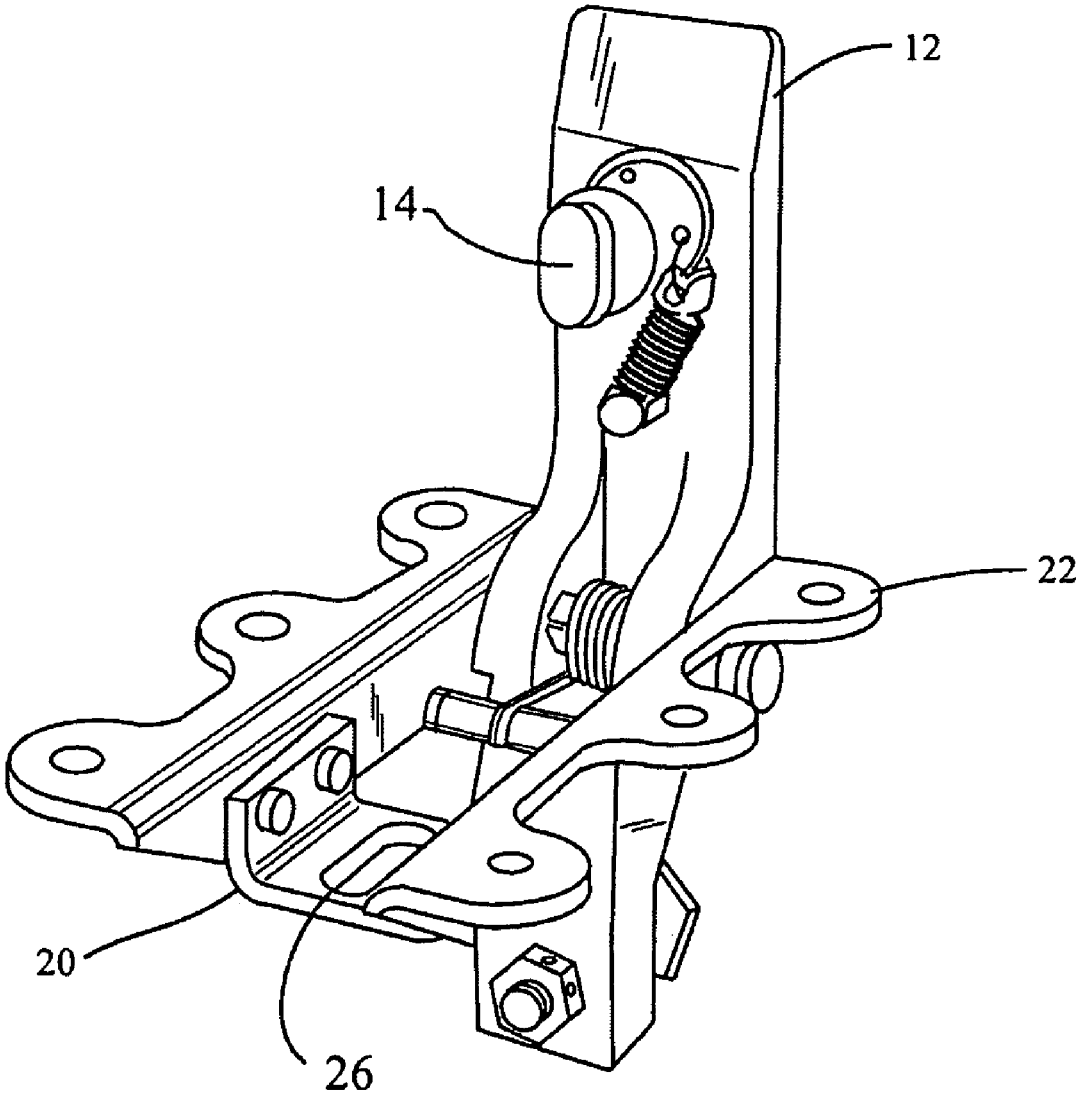
FIG. 12 shows a bottom perspective view of an embodiment of the present flush latch in the open position.

FIG. 12 shows an unlocked and opened view of the latch 10. The lock member 14 is shown in alignment with the lock member retention structure 26 of the lower latch member 20. The engagement surface for the support structure 22 of the lower latch 20 is shown with three engagement areas per side for a total of six engagement holes, although more holes or less holes is certainly within the contemplation of the disclosed device.

Figure 13:
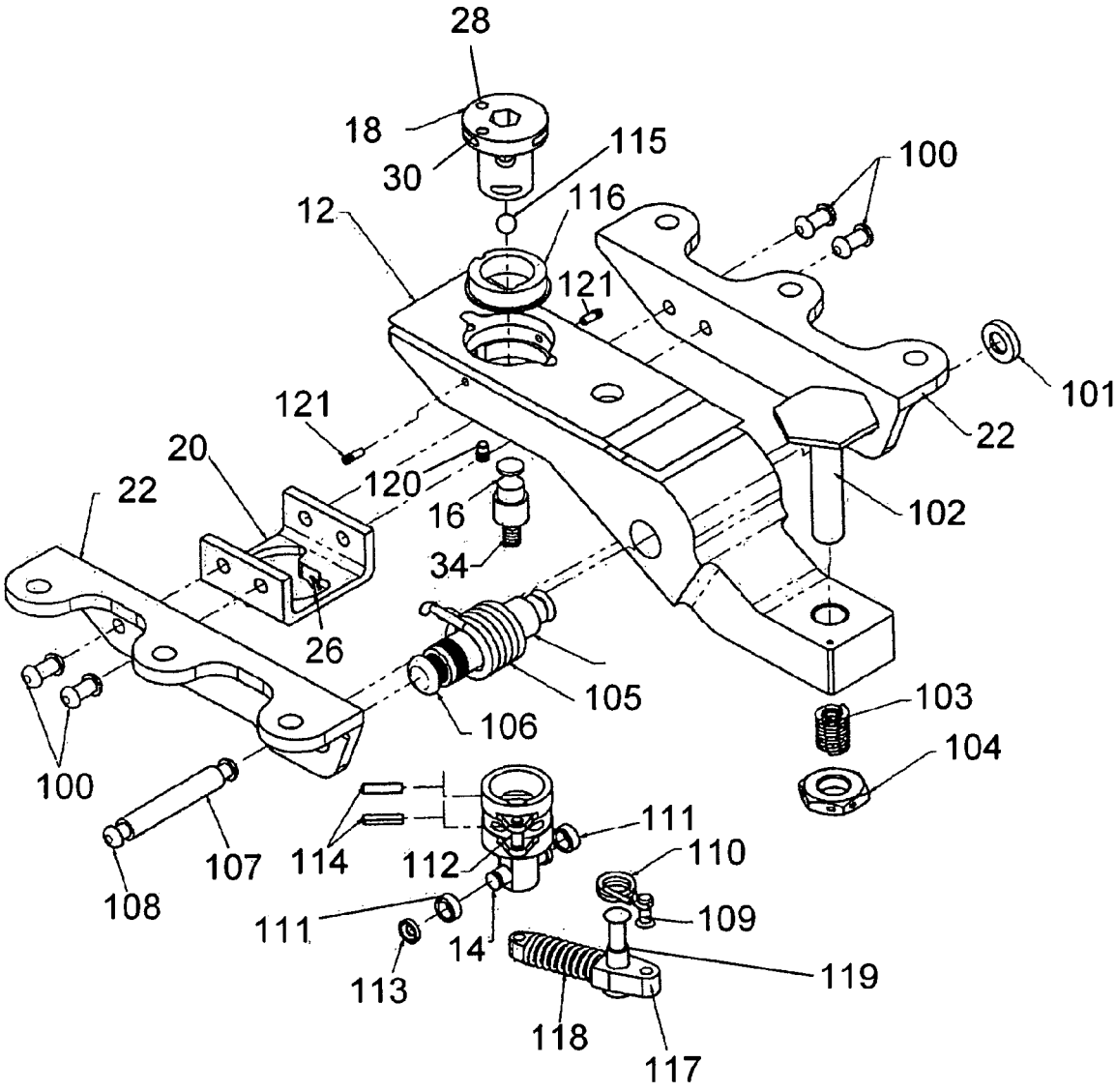
FIG. 13 shows an exploded view of an embodiment of the present flush latch.

FIG. 13 is an exploded view of an embodiment of the disclosed device. The parts shown are representative of the parts that could be used to manufacture the latch. The upper latch member 12, rotatable lock member 14, lock member movement means 16 and the lock position visual indicator 18 can be seen, as can the lower latch member 20, the support structure 22 and the lower latch retention structure 26. The pivot 24 that couples the upper latch 12 and the lower latch 20 can be seen. The reference dot visual indicators 28 and 30 can also be seen. The spring 34 can be seen in this Figure. Additional positive locking may be provided by spring 34, as spring 34 may be used to maintain the lock member 14 in a locked position as a secondary locking system. Also shown are the rivets 100, a hex bolt 102, a helicoil 103, and a nut 104. The pivot 24 can comprise a bushing 105, a torsion spring 106 that surrounds the bushing 105, a washer 101, a rivet 108 and a bushing 107, wherein the rivet 108 extends through the bushing 107. The lock member 14 can comprise a pair of rollers 111 and a pair of washers 113, although only one washer 113 is shown, the other washer 113 would be placed in the same position as the shown washer 113 relative to the roller 111. The lock member 14 may also comprise a pin 112 and a pair of groove pins 114. A ball 115 and a bushing 116 can be placed between the lock member 18 and the lock movement means 16 if desired. A guide 117 can comprise a first connection end and a second connection end, a rivet 109, a torsion spring 110, a compression spring 118, and a step rivet 119. The upper latch member 12 may comprise a pin 120 and a pair of opposed knurled pins 121. The claimed structures can be comprised of alternate conceivable parts, as the replacement of the rivets 100, 108, 109, and 119 by a nut and bolt assembly or screws is clearly within the claimed device.

What is claimed is:

1. An aircraft panel latch having a locked position and an unlocked position, the aircraft panel latch comprising:

an upper latch member comprising a rotatable lock member having an outwardly extending leg, a lock member movement means operatively connected to said lock member, and a lock position visual indicator; and a lower latch member, said lower latch member pivotally connected to said upper latch member, said lower latch member comprising a support structure and a lock member retention structure, said lock member retention structure comprising a ramping structure wherein the upper latch member is pivotally moveable between an open and a closed position, the rotatable lock member extending into the lock member retention structure when the upper latch member is in the closed position, and further wherein the outwardly extending leg of the rotatable lock member is urged along the ramping structure by rotation of the rotatable lock member to a locked position of the rotatable lock member, the engagement of the outwardly extending leg with the ramping structure securing the upper latch member firmly in place when the rotatable lock member is in a locked position.

2. An aircraft panel latch of claim 1 wherein said visual indicator comprises color coded indicia, wherein the alignment of a first color set indicates the latch is in the unlocked position and the alignment of a second color set indicates the latch is in the locked position.

3. The aircraft panel latch of claim 1 further comprising a spring which biases the latch in the locked position.

4. An aircraft panel latch having a locked position and an unlocked position, the aircraft panel latch comprising:

an upper latch member comprising a rotatable lock member, a lock member movement means operatively connected to said lock member, wherein said lock member movement means is deployed between a locked flush position relative to the aircraft panel and an unlocked non-flush position relative to the aircraft panel; and a lower latch member, said lower latch member pivotally connected to said upper latch member, said lower latch member comprising a support structure and a lock member retention structure, said lock member retention structure wherein the upper latch member is pivotally moveable between an open and a closed position, the rotatable lock member extending into the lock member retention structure when the upper latch member is in the closed position, and further wherein the portion of the rotatable lock member is urged along the ramping structure by rotation of the rotatable lock member to a locked position of the rotatable lock member, the engagement of the portion of the rotatable lock member with the ramping structure securing the upper latch member firmly in place when the rotatable lock member is in a locked position.

5. The aircraft panel latch of claim 4 wherein said rotatable lock member further comprises color coded indicia, wherein the alignment of a first color set indicates the latch is in the unlocked position and the alignment of a second color set indicates the latch is in the locked position.

6. The aircraft panel latch of claim 4 comprising a spring which biases the latch in the locked position.

7. An aircraft panel latch comprising:

An upper latch member comprising a rotatable lock member, a lock member movement means operatively connected to said lock member wherein the insertion and rotation of an activation tool into an opening in the lock member movement means operates said lock member movement means between a locked and unlocked position, said upper latch member further comprising a lock position visual indicator; and a lower latch member, said lower latch member pivotally connected to said upper latch member, said lower latch member comprising a support structure and lock member retention structure, said lock member retention structure comprising a ramping structure upon which a portion of the rotatable lock member rotatingly engages as the latch is placed in the locked position wherein the upper latch member is pivotally moveable between an open and a closed position, the rotatable lock member extending into the lock member retention structure when the upper latch member is in the closed position and further wherein the engagement of the portion of the rotatable lock member with the ramping structure securing the upper latch member firmly in place when the rotatable lock member is in a locked position.

8. The aircraft panel latch of claim 7 wherein said visual indicator comprises color coded indicia, wherein the alignment of a first color set indicates the latch is in the unlocked position and the alignment of a second color set indicates the latch is in the locked position.

9. The aircraft panel latch of claim 7 further comprising a spring which biases the latch in the locked position.

10. The aircraft panel latch of claim 7 wherein said activation tool is a hex wrench.

* * * * *